US010051984B2

(12) United States Patent
Buerck et al.

(10) Patent No.: US 10,051,984 B2
(45) Date of Patent: Aug. 21, 2018

(54) GARMENT ASSEMBLY AND RELEASE APPARATUS AND METHOD

(71) Applicant: FirstSpear, LLC, Fenton, MO (US)

(72) Inventors: Trevor S. Buerck, Imperial, MO (US); Scott J. Carver, Manchester, MO (US); Michael E. Cole, Ste. Genevieve, MO (US)

(73) Assignee: FirstSpear, LLC, Fenton, MO (US)

( * ) Notice: Subject to any disclaimer, the term of this patent is extended or adjusted under 35 U.S.C. 154(b) by 540 days.

(21) Appl. No.: 14/358,640

(22) PCT Filed: Nov. 19, 2012

(86) PCT No.: PCT/US2012/065854
§ 371 (c)(1),
(2) Date: May 15, 2014

(87) PCT Pub. No.: WO2013/119294
PCT Pub. Date: Aug. 15, 2013

(65) Prior Publication Data

US 2014/0332572 A1 Nov. 13, 2014

Related U.S. Application Data

(60) Provisional application No. 61/561,802, filed on Nov. 18, 2011.

(51) Int. Cl.
*A41D 1/04* (2006.01)
*A47G 25/90* (2006.01)
(Continued)

(52) U.S. Cl.
CPC ..... *A47G 25/90* (2013.01); *A41F 1/00* (2013.01); *A44B 11/2596* (2013.01); *F41H 1/02* (2013.01);
(Continued)

(58) Field of Classification Search
CPC ... A44B 11/2592; A44B 11/2596; A41F 1/00; A41F 1/006; A41F 1/008; F41H 1/02
(Continued)

(56) References Cited

U.S. PATENT DOCUMENTS 796,414 A * 8/1905 Chayes ..... A41F 3/02 24/319
3,979,801 A * 9/1976 Tareau ..... A41F 1/006 24/587.12
(Continued)

FOREIGN PATENT DOCUMENTS

EP 2363034 A1 * 9/2011 ..... A44B 11/008

*Primary Examiner* — Nathan Durham
(74) *Attorney, Agent, or Firm* — Matthews Edwards LLC

(57) ABSTRACT

The assembly and release apparatus and method utilizes a C-shaped clip defining a channel and a smaller slot extending along the channel, both open at at least one end, attachable to a first location on a garment. A pin of the apparatus is slidably receivable in the channel through the open end to assemble the C-shaped clip and the pin together. The pin has a tab or strip that extends through the slot, for attaching the pin to a second location on the garment. The apparatus includes at least one detent element associated with one of the C-shaped clip and the pin, cooperatively engageable with the other of the C-shaped clip and the pin for retaining the pin in the channel, and releasable in a predetermined manner to allow slidably removing the pin from the channel through the open end, to provide a quiet and rapid manner of operation.

24 Claims, 13 Drawing Sheets

(51) Int. Cl.
*F41H 1/02* (2006.01)
*A41F 1/00* (2006.01)
*A44B 11/25* (2006.01)

(52) U.S. Cl.
CPC ..... *A41D 2300/30* (2013.01); *A41D 2300/50* (2013.01); *A41D 2400/44* (2013.01); *Y10T 24/346* (2015.01)

(58) Field of Classification Search
USPC ..... 24/419, 429, 612
See application file for complete search history.

(56) References Cited

U.S. PATENT DOCUMENTS 4,054,972 A * 10/1977 Rowell ..... A41C 3/02 24/698.2
4,578,843 A * 4/1986 Lewis ..... A44B 11/2596 24/319
4,790,050 A * 12/1988 Ishii ..... A44B 19/262 24/419
6,009,604 A * 1/2000 Fildan ..... A41F 1/006 24/318
7,047,570 B2 5/2006 Johnson
7,480,967 B2 * 1/2009 Kojoori ..... A44B 11/006 2/322
7,814,567 B2 * 10/2010 Dovner ..... F41H 1/02 2/2.5
7,979,917 B2 7/2011 Osborne
7,987,523 B2 8/2011 Cole et al.
8,056,196 B2 11/2011 Sample et al.
2010/0263171 A1 * 10/2010 Paik ..... A44B 11/25 24/194

* cited by examiner

GARMENT ASSEMBLY AND RELEASE APPARATUS AND METHOD

This application is submitted under 35 U.S.C. 371 claiming priority to PCT/US2012/65854, filed Nov. 19, 2012, which application claims the benefit of U.S. Provisional Application No. 61/561,802, filed Nov. 18, 2011.

TECHNICAL FIELD

The present invention relates generally to assembly and release apparatus and method for a garment such as a ballistic vest or the like, and more particularly, which provides a quiet and rapid manner of donning and doffing the garment, so as to be usable for both standard doffing and donning, and rapid release for emergency and injury situations and the like.

BACKGROUND ART

U.S. Provisional Application No. 61/561,802, filed Nov. 18, 2011, is incorporated herein by reference in its entirety.

There has long been various garments, such as, but not limited to, vests, particularly those used in tactical and military operations, such as ballistic vests including armor, that have apparatus for assembling and securely holding the garment on or about the user's body. Known ballistic vests in particular often have complex systems for placing and assembling the vest about the body, herein also referred to as doffing the vest or garment, typically utilizing a complex system of belts and straps that take significant time and familiarity to assemble and adjust, and for removing or doffing it. As a result, there has also long been apparatus and systems for rapid removal of garments such as ballistic vests in emergency situations such as combat to enable inspecting and treating injuries to the wearer's body, and to facilitate escape from dangerous situations such as immersion in water. These rapid removal apparatus and systems are typically in addition, but often connected, to the apparatus or systems for donning and doffing the garment.

Reference in this regard, the ballistic vest disclosed in U.S. Pat. No. 7,047,570, which discloses front and rear portions that can separate completely from one another, while a waist belt and cummerbund of the vest have an end that separates from at least one of the front and rear portions. This vest uses a complex system of belting and straps for normal donning and doffing. Because of this complexity, a rapid release system is provided which utilizes a flexible retainer including a cable that can be quickly pulled to break the vest into pieces for removal. However, a disadvantage of this system is that once it is used, reassembly of the vest and rigging of the rapid release system is time consuming and involves threading portions of the retainer through regions of the vest, which can be difficult, particularly under challenging condition such as darkness and combat, and during which assembly the user is left unprotected. As another disadvantage, because an additional system is used for rapid release, the vest is heavier than desired.

Reference also the ballistic vest disclosed in U.S. Pat. No. 7,979,917, which discloses a rear break away feature, but suffers from similar disadvantages, namely, the feature is in additional to the elements for normal donning and doffing the vest; complexity; time consuming reassembly; and additional weight.

Reference also U.S. Pat. No. 7,987,523 which discloses a quick release garment which is also a ballistic vest, that utilizes a flexible retainer similar to that of U.S. Pat. No. 7,047,570, but which does not result in complete separation of components of the vest when the quick release feature is used. However, it still requires additional apparatus for quick release; is complex, heavy, and time consuming to reassemble.

Reference further, U.S. Pat. No. 8,056,196 which discloses a quick release fitting having utility for use in garments such as ballistic vests and the like, that would eliminate one or more of the disadvantages set forth above, namely, the requirement for additional apparatus for rapid release, but which is potentially disadvantageous as it utilizes a relatively complex multiple spring loaded release mechanism that could malfunction in dirty and other adverse environments.

Thus, what is sought is an assembly and release apparatus and method for a garment such as a ballistic vest or the like, that provides a quiet and rapid manner operation, usable for both standard donning and doffing, as well as rapid release, and which provides at least some weight advantage, and overcomes one or more of the disadvantages set forth above.

SUMMARY OF THE INVENTION

What is disclosed is an assembly and release apparatus and method for a garment such as a ballistic vest or the like, that provides a quiet and rapid manner operation, usable for both standard donning and doffing, as well as rapid release, and which provides at least some weight advantage, and overcomes one or more of the disadvantages set forth above.

According to a preferred aspect of the invention, the apparatus includes a C-shaped clip defining a channel and an open slot extending along the channel, open at at least one end of the clip, and including at least one element configured for attaching the C-shaped clip to a first location on the garment. The apparatus includes a pin slidably receivable in the channel of the C-shaped clip through the open end to assemble the C-shaped clip and the pin together. The pin has a tab or strip configured to extend through the slot, for attaching the pin to a second location on the garment, the slot being sufficiently small to prevent passage of the pin therethrough. The apparatus additionally includes at least one detent element associated with one of the C-shaped clip and the pin, cooperatively engageable with the other of the C-shaped clip and the pin for retaining the pin in the channel, the detent element being releasable in a predetermined manner to allow slidably removing the pin from the channel through the open end.

In a preferred manner of operation, with the C-shaped clip attached to the first location on the garment, and the pin attached to the second location, the pin can be slidably inserted into the channel of the C-shaped clip, and the detent element or elements engaged, to securely hold the locations of the garment together. Separating the locations entails simply releasing the detent element or elements. A preferred garment is a ballistic vest, and the locations can comprise, for instance, but are not limited to, and edge or edges of a front panel of the vest, and side elements such as a belt or cummerbund, and also an upper edge of the front panel and a shoulder strap or straps. As a result, the pin can be engaged with and disengaged from the clip quickly and easily so that the garment can be donned and doffed rapidly, which is a valuable advantage under the conditions set forth above.

According to one preferred embodiment, the at least one detent element comprises a tab extending from the C-shape clip, cooperatively engageable with or receivable in a receptacle in the pin, and removable therefrom in a predetermined motion, such as with a convenient and simple manual pulling motion, which can be accomplished under stressful and low visibility conditions. The C-shaped clip and the pin can be elongate, and the tab located at about a central portion of the C-shaped clip. Additionally the assembled clip and pin can be generally flat, so as to not be obtrusive. As an alternative construction, the detent element can comprise a cover, e.g., of a fabric material, over the open end or ends of the C-shaped clip, and which can be easily grasped and moved using a finger or fingers, so as to also be quickly and simply accomplished. In this regard, the clip and/or the pin can be fabric covered, e.g., with a camouflage fabric if desired.

As another preferred aspect of the invention, the channel of the C-shaped clip and the pin have mating D-shapes when viewed from the end thereof, with flat surfaces of the D-shape being located adjacent to opposite sides of the slot, for added strength, and to improve tactile feel for assembly under low light and other difficult conditions.

As still another preferred aspect of the invention, the C-shaped clip and the pin have mating surfaces bounding the channel adjacent to at least one side of the slot, which are tapered at less than a 90 degree angle, e.g., 75-85 degrees, to the slot such that when the pin is located in the channel and a force is exerted against the tab or strip in a direction to pull the pin toward or through the slot, the surface of the clip adjacent to the slot will be drawn toward the slot to prevent passage of the pin therethrough. This feature can be incorporated with the D-shaped feature discussed above, and can be located on opposite sides of the slot, for greater strength.

DETAILED DESCRIPTION OF THE INVENTION

Referring to FIGS. 1 through 8, assembly and release apparatus 20 constructed and operable according to the teachings of the present invention, are shown at several location on a representative garment, which here is a ballistic vest 36, that provides a quiet and rapid manner of operation, usable for both standard donning and doffing, as well as rapid release, and which provides at least some weight advantage, and overcomes one or more of the disadvantages set forth above.

Figure 1:
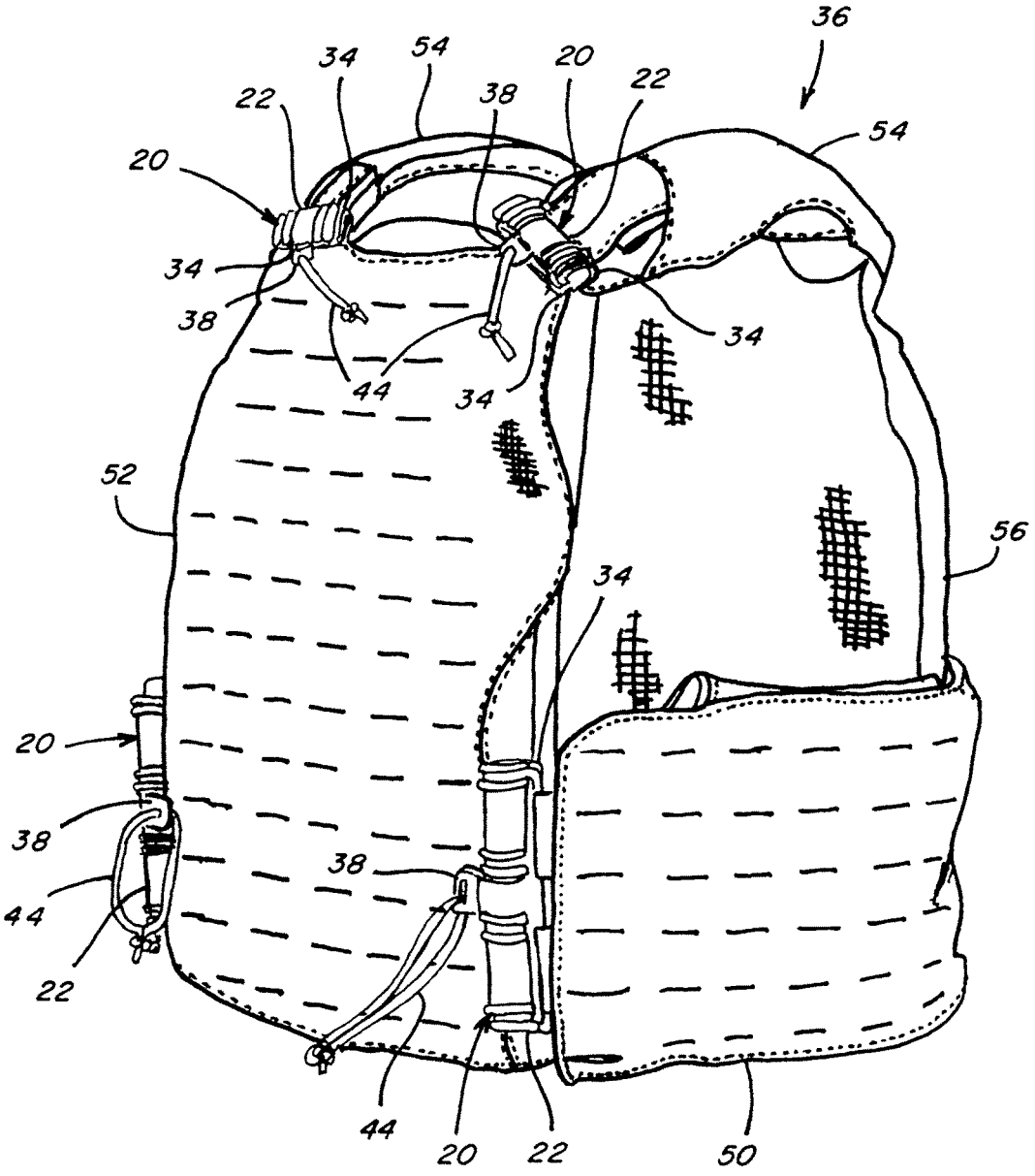
FIG. 1 is a perspective view of a representative garment which is a ballistic vest including assembly and release apparatus of the invention connecting elements of the vest together.
Figure 2:
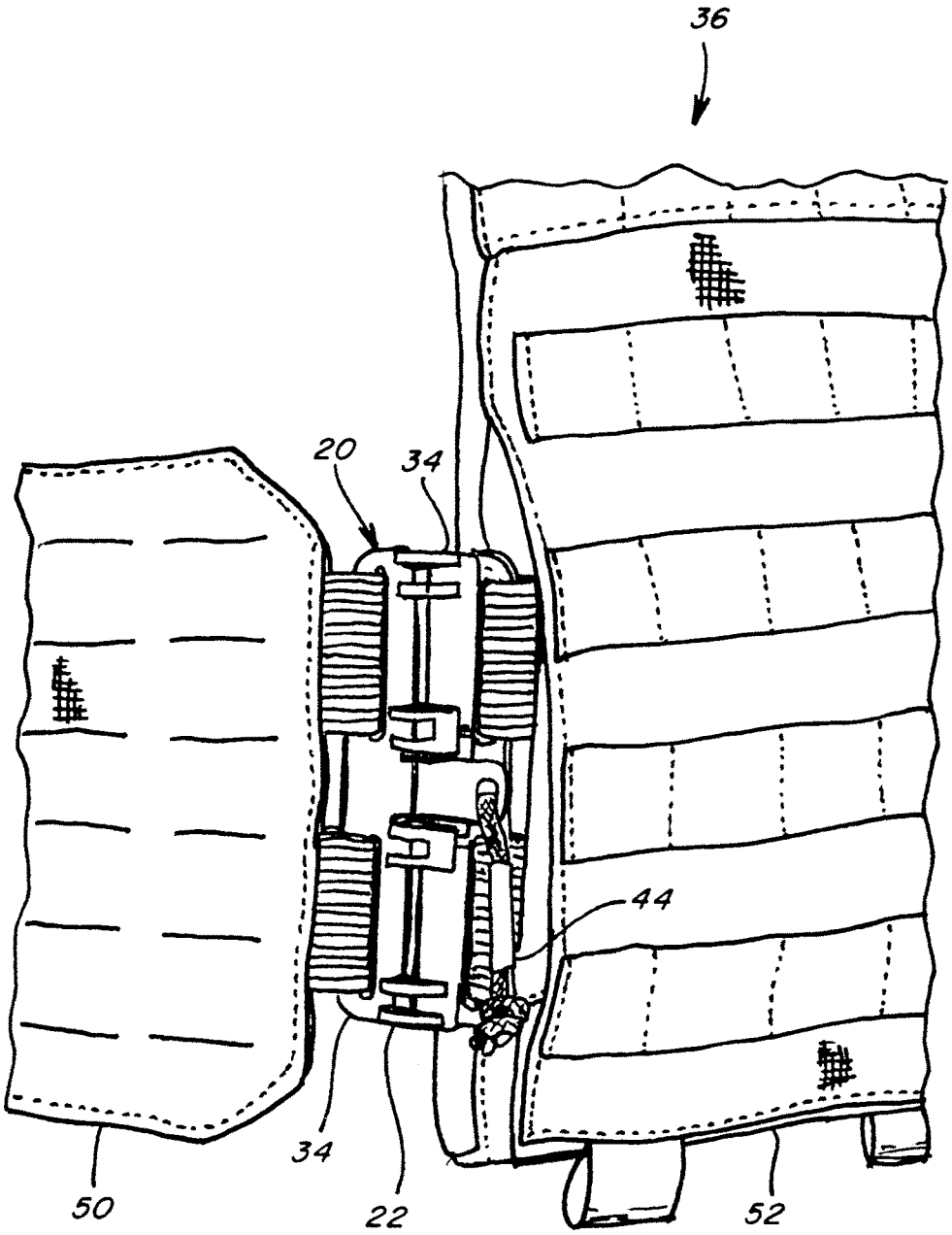
FIG. 2 is an enlarged fragmentary perspective view of the vest of FIG. 1 showing one of the assembly and release apparatus connecting a front panel and a cummerbund of the vest together.
Figure 3:
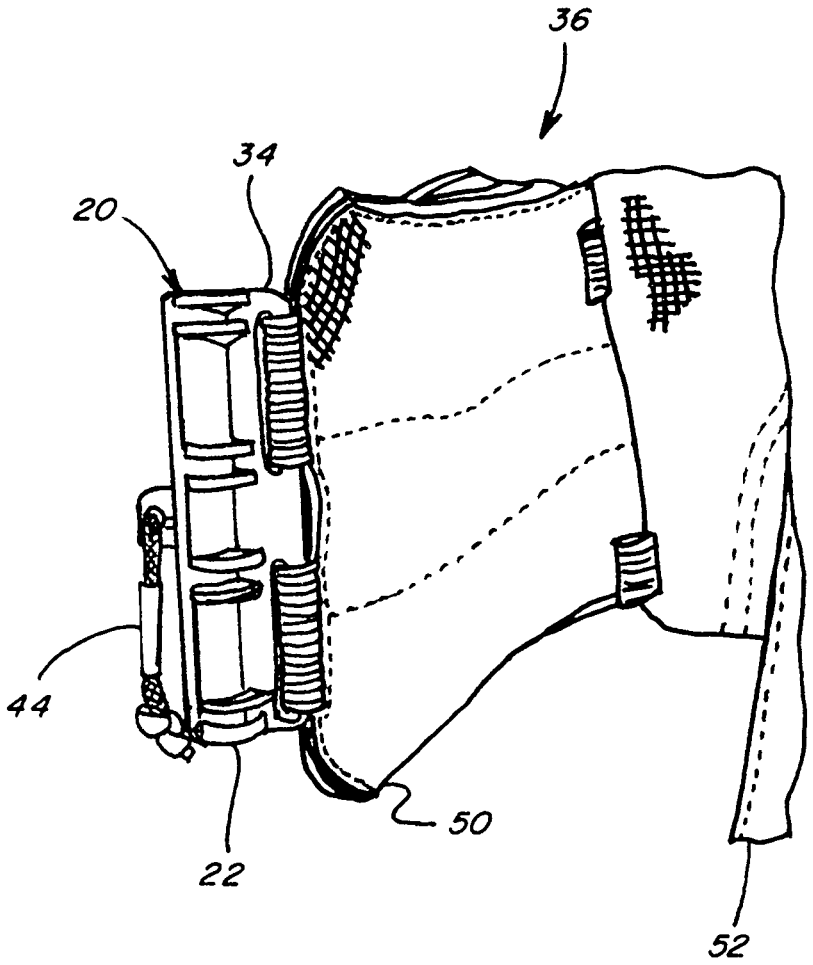
FIG. 3 is another fragmentary perspective view of the vest, showing aspects of the invention on the cummerbund.
Figure 4:
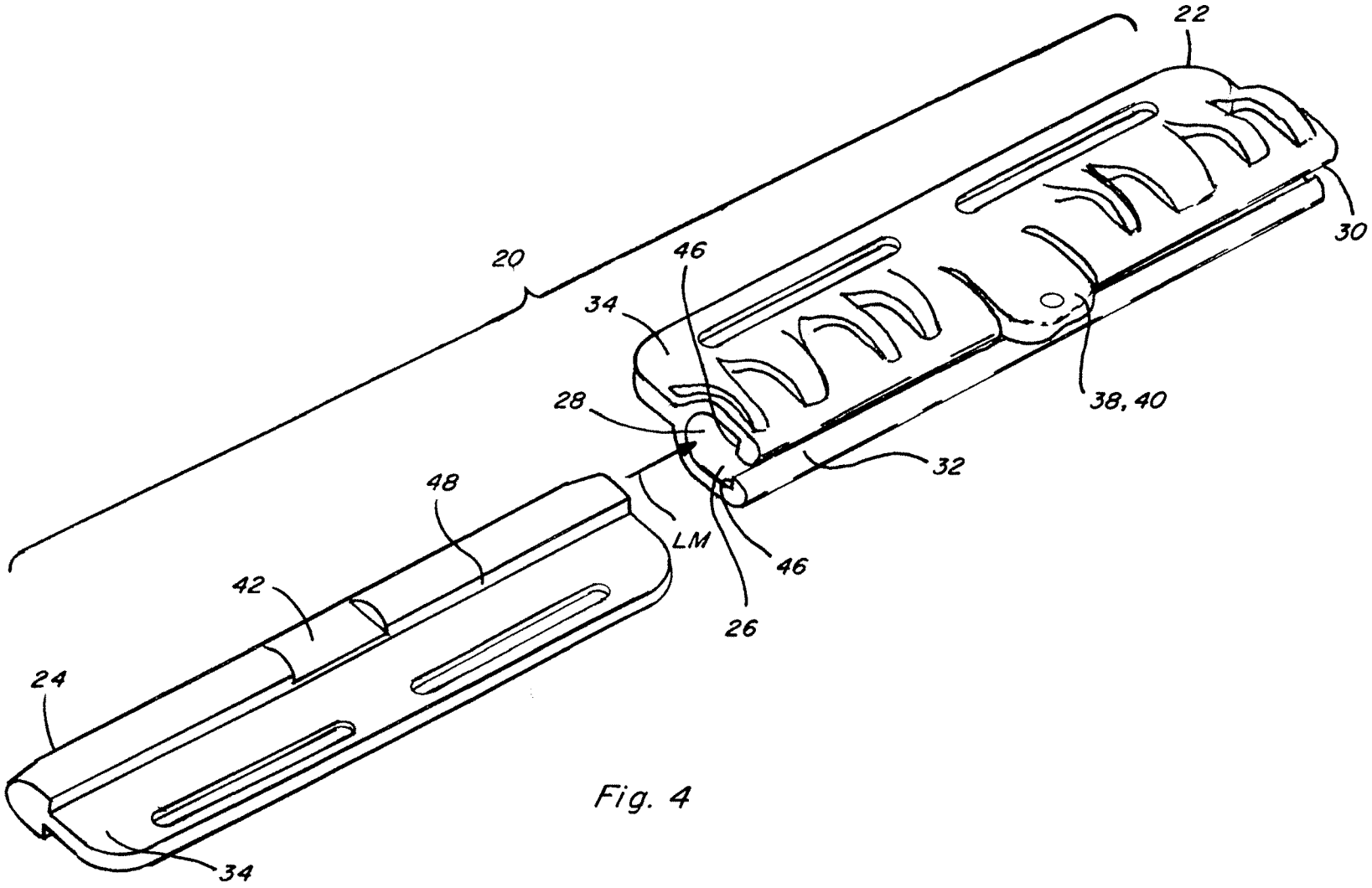
FIG. 4 is perspective view of a representative assembly and release apparatus of the invention, shown in a disassembled state.
Figure 5:
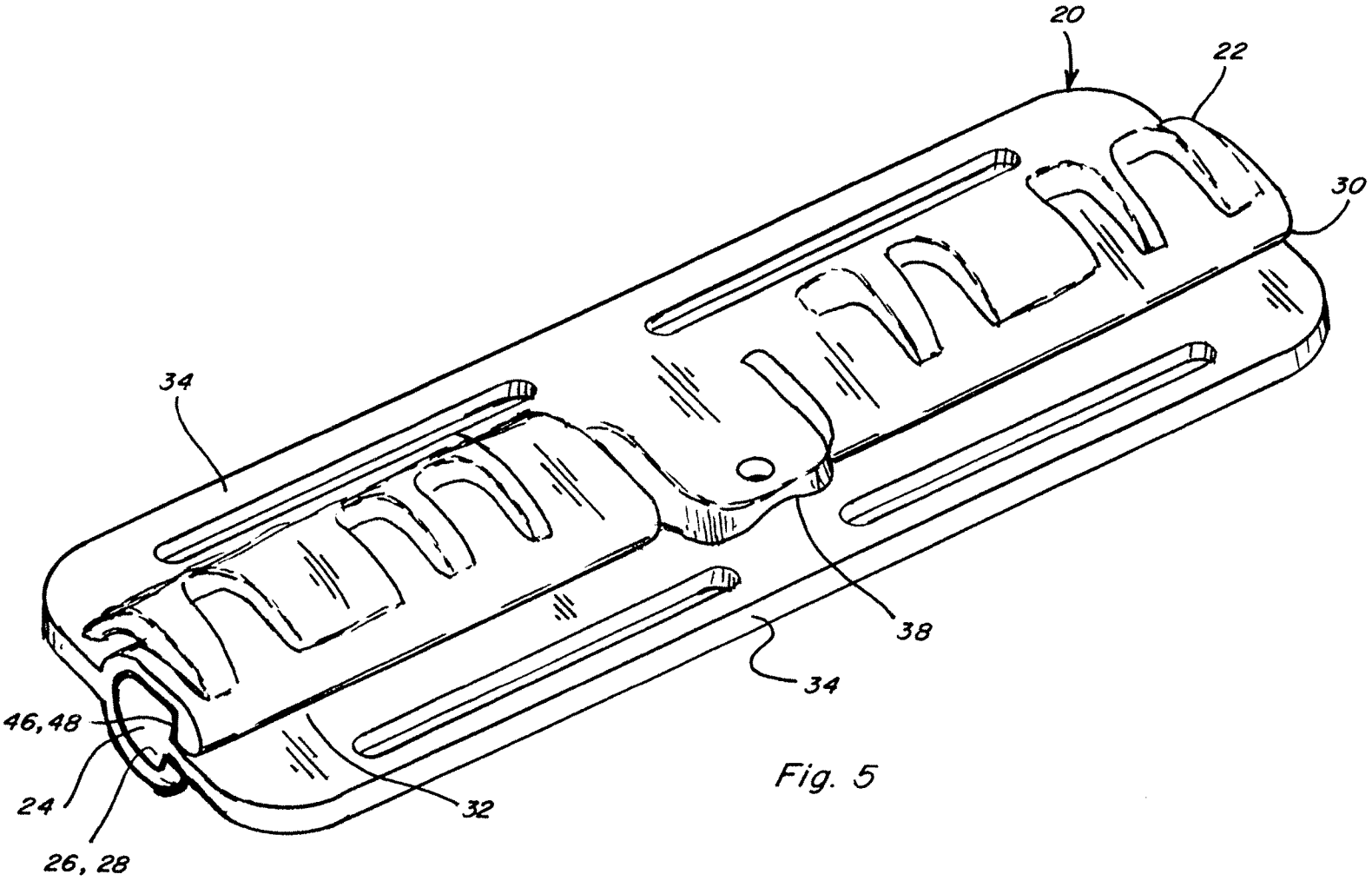
FIG. 5 is an enlarged perspective of the representative assembly and release apparatus of the invention, shown in an assembled state.

The assembly and release apparatus 20 includes a C-shape female clip 22 which is attached to a first element or location of the garment to be connected to another element or location, and an elongate male pin 24 attached to the second element or section and with relative longitudinal movement as denoted by arrow LM in FIG. 4, is cooperatively receivable in the C-shape clip 22 for connecting the garment element or sections together. As best shown in FIGS. 4-7, the C shape clip 22 extends partially circumferentially about and defines an elongate channel 26 open at at least one longitudinal end 28, 30 for receiving the elongate pin 24, and has a longitudinally extending slot 32 along the channel 26 also.

Figure 6:
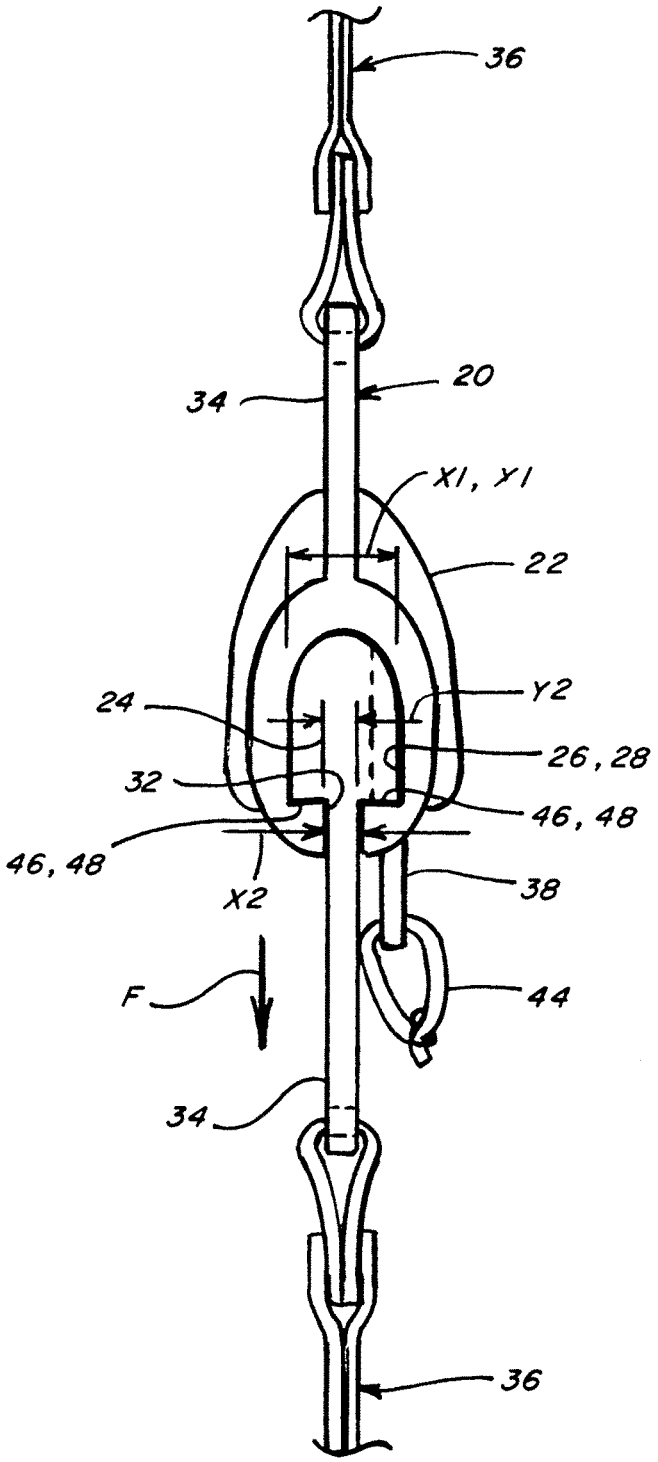
FIG. 6 is an end view of the apparatus of the invention, showing a detent element of the invention in an engaged state for retaining a pin of the apparatus.

Both the C-shape clip 22 and the pin 24 are preferably attached to its respective element or location of the garment (vest 36) by at least one tab or strip 34 that extends longitudinally along the clip 22 or pin 24, and the tab or strip 34 of the pin 24 is cooperatively received in the slot 32 of the clip 22. As best shown in FIG. 6, the pin 24 preferably has a sectional extent X1 transverse to the longitudinal direction that about equal to or only marginally smaller than the transverse extent Y1 of the channel, so that the pin 24 is relatively easily slidable along the channel 26 by movement LM, but not loose. The slot 32 is just sufficient in width Y2 to receive the tab or strip 34, which is relatively narrow in thickness (X2) transverse to the longitudinal direction, but not large enough for passage of the pin 24 transversely from the channel 26. The channel 26 and pin 24 can have substantially mating cross sectional shapes, such as, but not limited to, a round shape, or a D-shape, as desired or required for a particular application.

The C-shape clip 22 is preferably sufficiently strong and rigid so as to resist breaking or deforming under forces anticipated to be exerted thereagainst, so as to be capable of restraining the pin 24 from transverse removal therefrom through the slot 32 under transverse and other forces anticipated to be exerted during use of the garment, as denoted by arrow F in FIG. 6. Suitable materials for both clip 22 and pin 24 can include metals and strong plastics such as a nylon or fiber reinforced resin. Such forces can vary and may be specifically designated in a performance specification for the particular garment, e.g., a ballistic vest 36 or other garment for military or law enforcement use.

Figure 7:
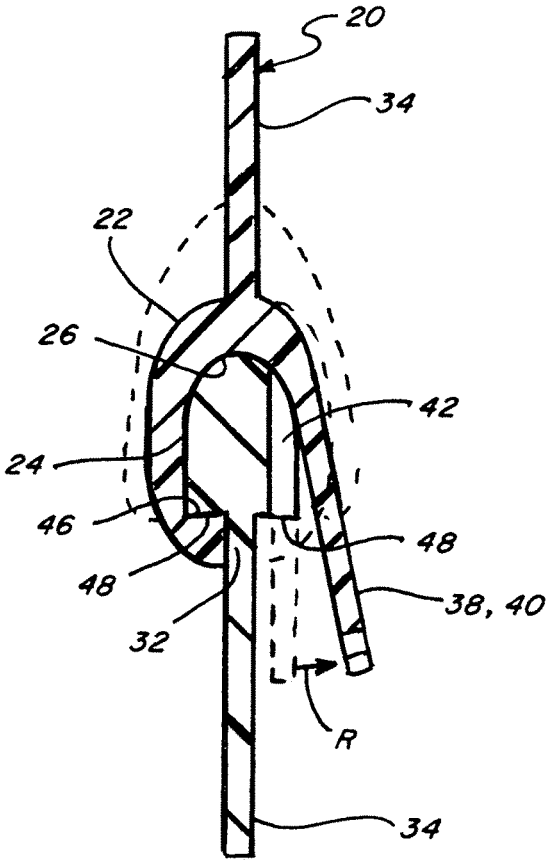
FIG. 7 is an enlarged sectional view of the apparatus, showing the detent element of the invention in a release state for allowing removal of the pin.
Figure 8:
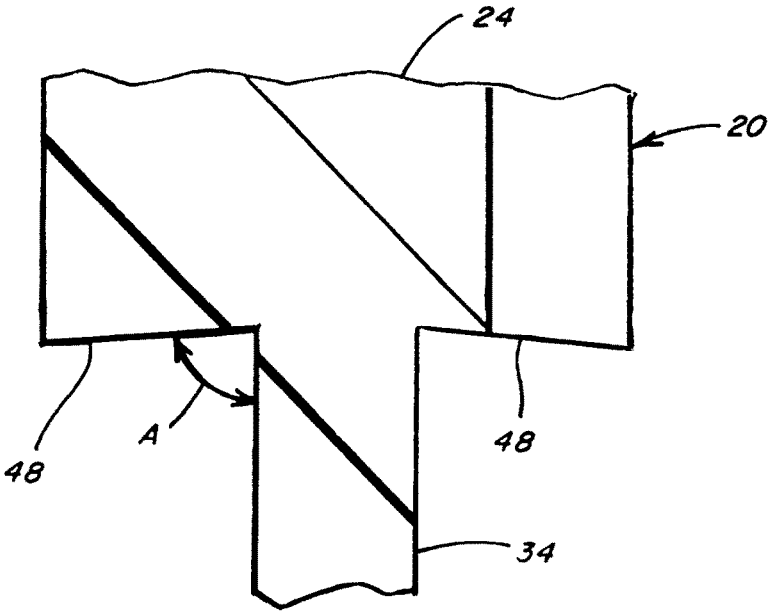
FIG. 8 is an enlarged fragmentary sectional view of a detail of the apparatus of the invention.

Release apparatus 20 additionally includes at least one detent element 38 configured and operable for retaining pin 24 in the longitudinal direction in channel 26 under forces anticipated to be exerted thereagainst during use of the garment, but which detent element is movable or deformable in a predetermined manner, e.g., by manual manipulation, to allow removal of the pin 24. As a non-limiting example, as best shown in FIGS. 4 and 7, the detent element can comprise a transversely extending tab 40 on clip 22, cooperatively receivable in a notch 42 in pin 24, both of which can be located along the respective lengths thereof, here, at a center or middle location along the lengths of the clip and pin. A convenient graspable feature, such as a fabric loop or cord 44 or the like, can be provided in connection with tab 40 to facilitate manually grasping tab 40 and pulling it transversely away from notch 42 when it is desired to release the pin, as denoted by arrow R in FIG. 7.

As another feature, C-shaped clip 22 and pin 24 preferably have mating surfaces 46, 48 bounding the channel adjacent to at least one side of the slot (here on both sides), which are tapered at less than a 90 degree angle A (FIG. 8), e.g., 75-85 degrees, to strip 34 (and slot 32) such that when pin 24 is located in channel 26 and a force F (FIG. 6) is exerted against tab or strip 34 in a direction to pull pin 24 toward or through slot 32, surfaces 48 of pin 24 will push against and draw surfaces 46 of the clip toward the slot to prevent passage of the pin therethrough for additional strength.

Figure 9:
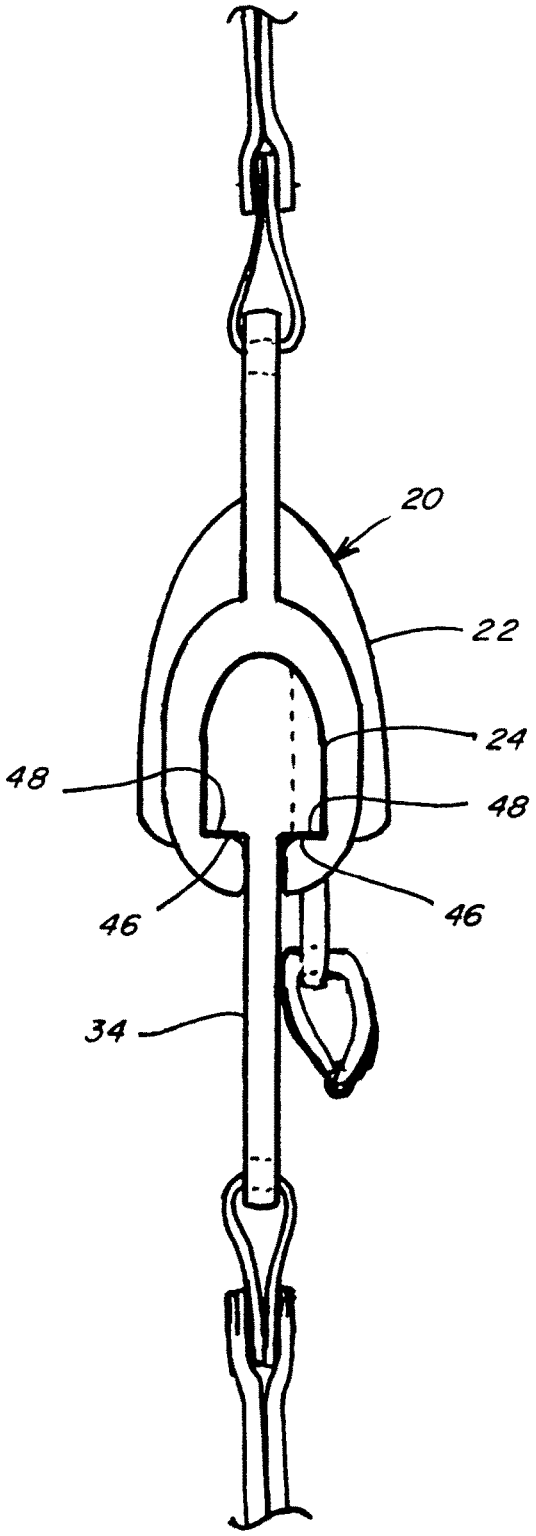
FIG. 9 is an end view of an alternative embodiment of the invention.
Figure 10:
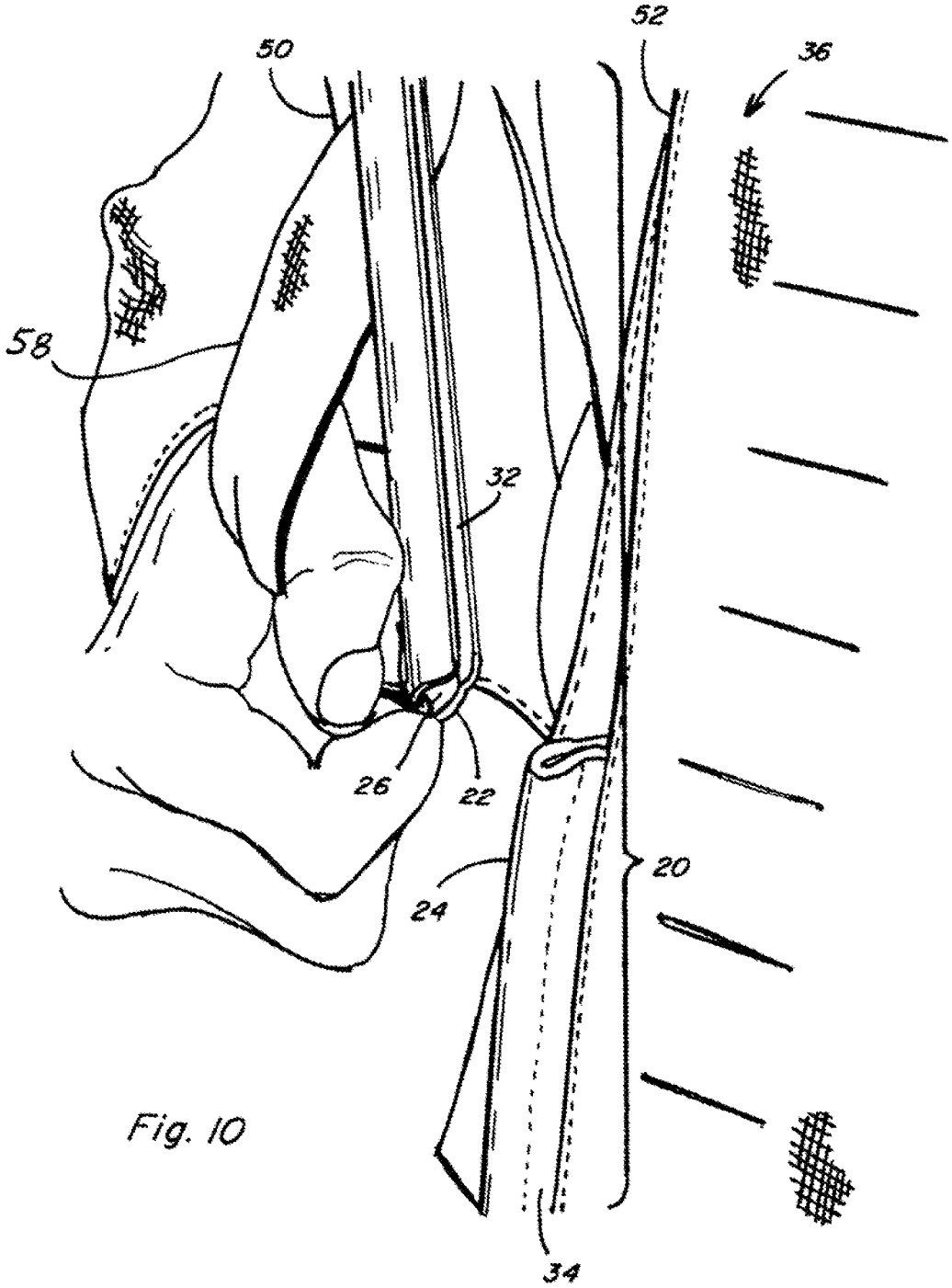
FIG. 10 is an enlarged fragmentary perspective view of the vest, showing another alternative embodiment of assembly and release apparatus of the invention for connecting elements of the vest, namely a cummerbund and front panel.

Referring also to FIG. 9, as an alternative construction of clip 22 and pin 24 of apparatus 20, surfaces 46 and 48 can be about perpendicular to slot 32 and strip 34, if desired.

Here, it should be noted that the assembly and release apparatus of the invention can be incorporated at various locations on a garment, such as, but not limited to, for connecting a belt or cummerbund 50 to a side edge of a front panel 52 of a ballistic vest 36, as shown in various of the FIGS. Another location is for connecting the upper edge of front panel 52 to shoulder straps 54, as also shown. Still other locations can include cummerbund or belt to a side edge of a rear panel 56 of the vest, and/or shoulder strap to rear panel, to name a few options. As illustrated, apparatus 20 can be sized accordingly for a particular location, to provide the required strength. Additionally, the clip 22 and pin 24 can be attached to the side of the connection that is most advantageous, as desired or required for the application. As non limiting examples, the C-shaped clips 22 can be located on cummerbund 50 and shoulder straps 54, and pins 24 on front panel 54, or vice versa.

Referring also to FIGS. 10-14, an alternative embodiment of assembly and release apparatus 20 is shown, wherein C-shaped clip 22 and pin 24 are still of a rigid material such as nylon, reinforced resin, or metal, but can be fabric covered if desired or required for a particular application. Channel 26 is similarly configured, positioned, and operable as discussed above, as is slot 32, such that assembly and release is essentially the same. That is, pin 24 is longitudinally received in channel 26 of clip 22, with strip 34 extending through slot 34 as illustrated. Assembly requires relative longitudinal movement as denoted by arrow LM in FIG. 11, as can be effected manually, for instance using a finger through an associated loop 58 on one of the elements to be connected. This will require offsetting the two elements of the garment during the initial alignment, e.g., lifting or shifting one relative to the other, then sliding them into alignment as the pin is slid into the clip.

Figure 11:
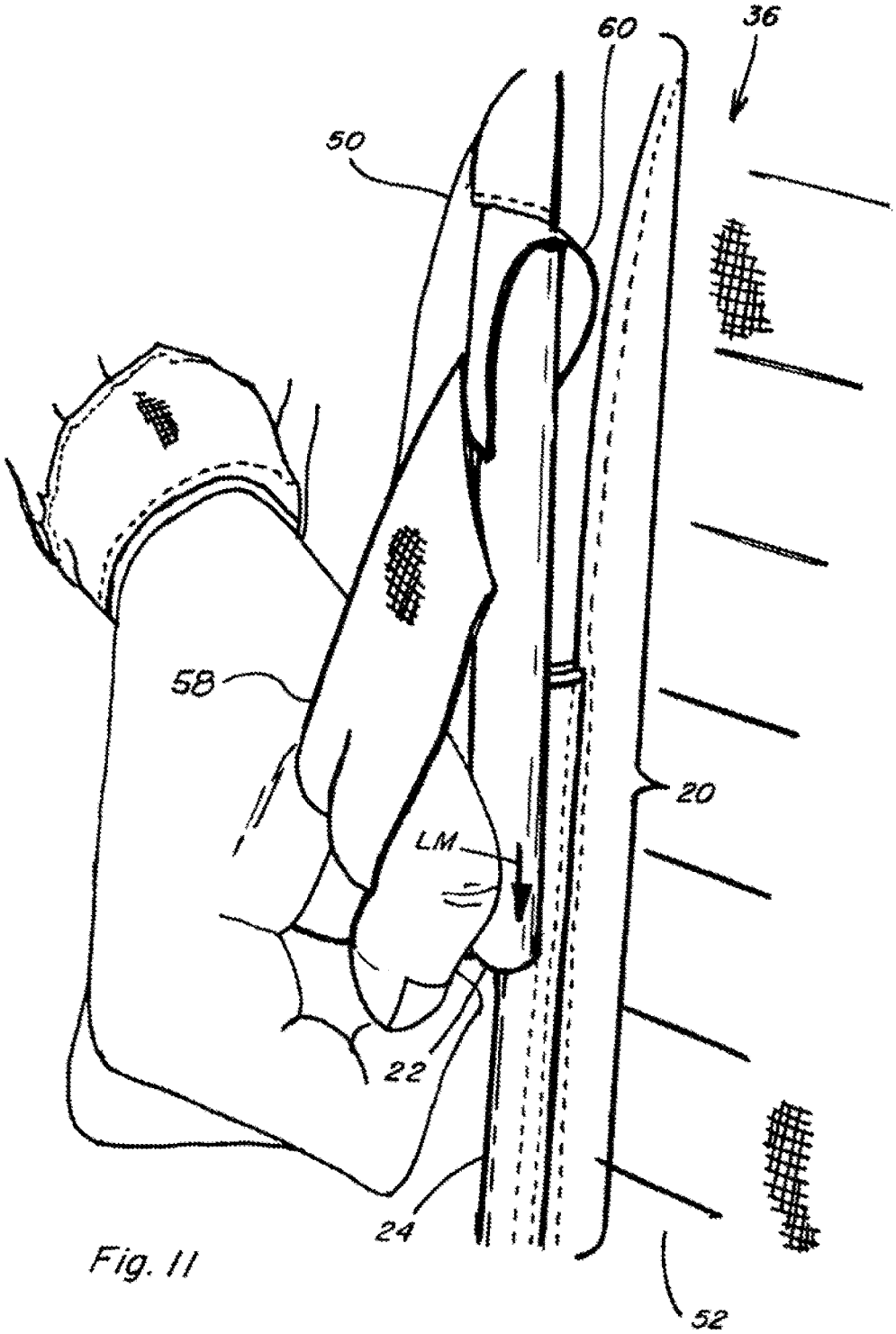
FIG. 11 is another enlarged fragmentary perspective view of the vest of FIG. 10, showing the apparatus of the invention partially assembled for connecting the cummerbund and the front panel.
Figure 12:
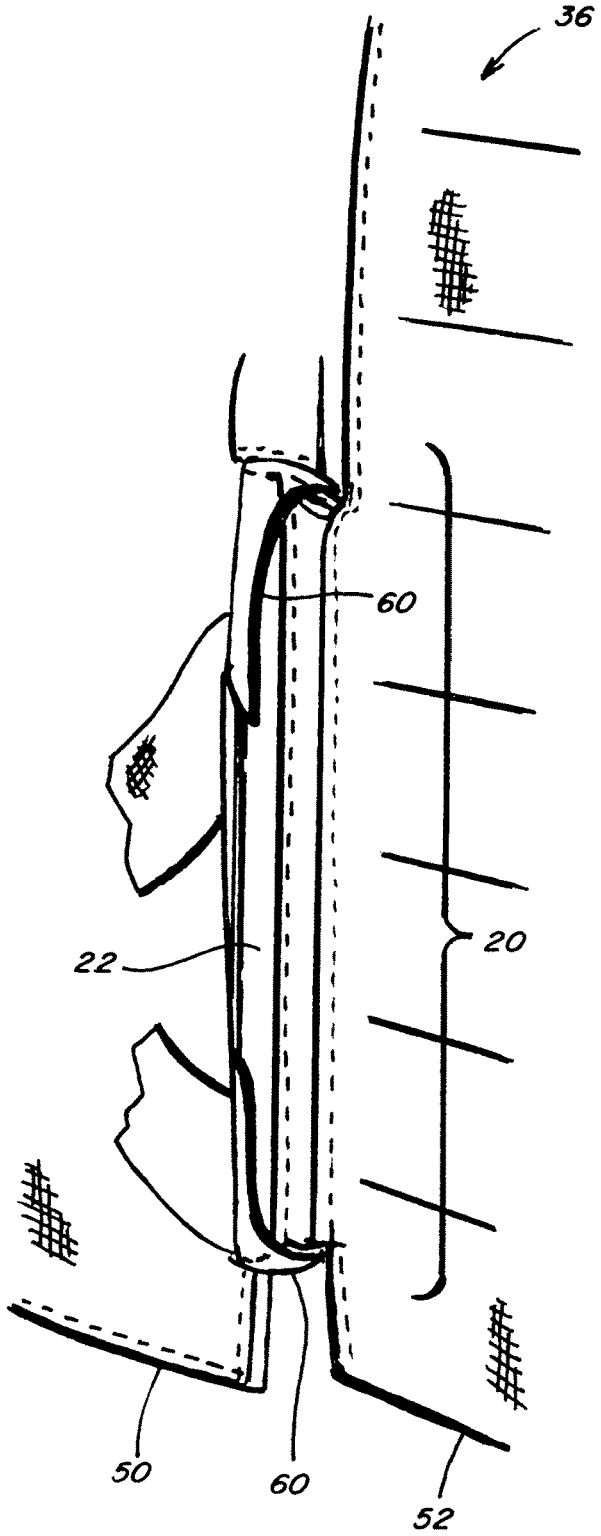
FIG. 12 is still another enlarged fragmentary perspective view of the vest of FIG. 10, showing the apparatus assembled connecting the cummerbund and the front panel.
Figure 13:
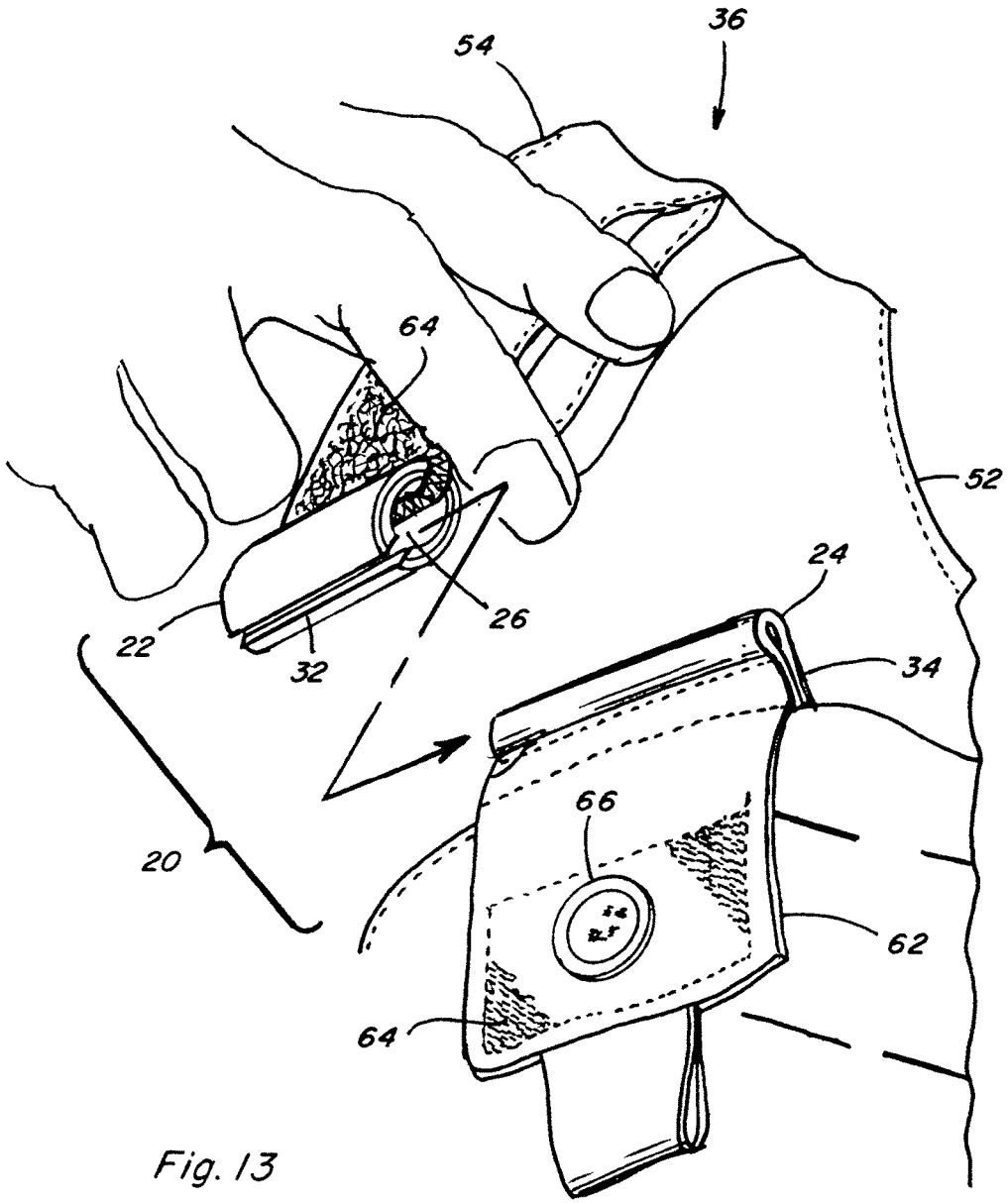
FIG. 13 is an enlarged fragmentary perspective view of the representative vest, showing another embodiment of assembly and release apparatus of the invention, for connecting the front panel to a shoulder strap of the vest.
Figure 14:
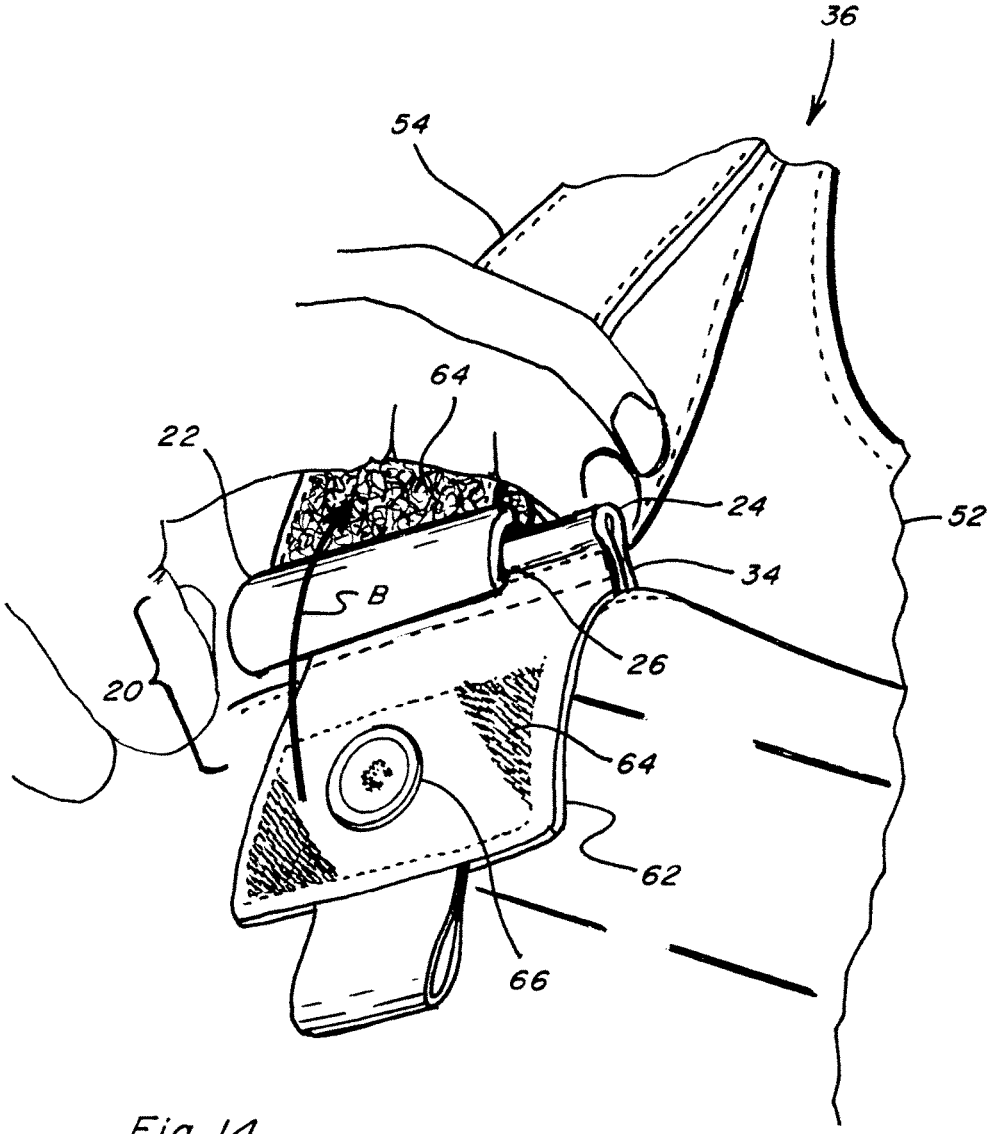
FIG. 14 is another enlarged fragmentary perspective view of the representative vest of FIG. 13, showing the apparatus of the invention partially engaged for connecting the front panel to the shoulder strap.

As detent elements, as shown in FIGS. 11 and 12, covers 60 can be provided in generally covering relation to the longitudinal ends of clip 22, for capturing pin 24 therein and preventing inadvertent or unintended disassembly. When disassembly is desired, the cover 60 at the desired end can be manually moved out of covering relation to the end of the clip to allow passage of the pin. Suitable materials for covers 60 can include, but are not limited to, plastics or fabric, e.g., material available under the Hypalon tradename, natural or synthetic leather, or other material As another non-limiting example, as shown in FIGS. 13 and 14, alternatively, flaps 62 and straps 54 can be provided with suitable detents, in the form of fasteners, such as hook and loop fasteners 64, and/or button snaps 66, engageable by folding or bending flap 62 into overlaying relation to the assembled apparatus 20 and the mating fastener element on strap 54, as denoted by arrow B in FIG. 14, for holding it in the assembled state and preventing longitudinal relative movement of clip 22 and pin 24. Here, it should be noted that at least the disconnection of apparatus 20 should be capable of being accomplished intuitively and easily by a person by feel only and under trying conditions such as darkness, and when muddy or in cold temperatures, so as to not inhibit rapid disconnection and assembly.

Also here, it should be noted that both of the C-clip 22 and pin 24 can be attached to the garment by common elements, such as straps, or sewed to the garment, riveted, and/or other well known attachment means. Either or both can also be covered with fabric material of the garment, as desired or required for a particular application, e.g., for camouflage purposes. As another alternative, clip 22 and pin 24 can be formed of a suitable rigid material such as a polyethylene, or engineered plastics material. The pin 24 can be of solid or tubular construction, as desired or required for a particular application.

As noted above, a garment can include one or more of the attachment and release apparatus 20 of the invention at a particular location, for connecting a particular element of the garment to another at that location. As a non-limiting example, for a vest 36 having a front panel 52, rear panel 56 and a cummerbund 50 or belt, apparatus of the invention 20 can be provided along adjacent side edges, or at desired locations; along a belt; and on the front and rear panels for connecting them together for donning the vest 36. If the vest 36 includes suspenders or shoulder straps 54, apparatus 20 of the invention can be included at one or more of the desired connection locations on or between the shoulder strap or straps and the other element of the vest to be connected, such as the front or rear panels. The apparatus 20 of the invention can also be used for connecting other items to the garment, such as, but not limited to, pouches, canteens, radios, holsters, straps, additional protective panels or elements, and the like (not shown).

Thus, as a method of donning a garment such as vest 36, the pin 24 of a first element of the garment is aligned with the end of the appropriate clip 22, and slid into the clip until fully received and detent element 38 engaged if provided. If an alternative or additional detent element such as cover 60 or flap 62 is used, they are placed or positioned over the ends of the apparatus and engaged and the connection at that location is complete. Then one or more additional connections are made using additional apparatus 20 to completely connect the garment together in the desired configuration. For doffing, particularly for rapid release, the detent elements are withdrawn or opened, and the pin or pins 24 removed from the C-shape clip or clips 22 of the desired apparatus 20. One or more of apparatus 20 may be disconnected as desired or required for a particular situation.

It will be understood that the foregoing descriptions are for preferred embodiments of this invention and that the invention is not limited to the specific forms shown. Other modifications may be made in the design and arrangement of other elements without departing from the scope of the invention as expressed in the appended claims.

What is claimed is:

1. An assembly and release apparatus for a garment, comprising:

a C-shaped clip defining a channel and an open slot extending along the channel, open at opposite ends of the clip, and including at least one element configured for attaching the C-shaped clip to a first location on the garment;

a pin slidably receivable in the channel of the C-shaped clip through either of the open ends to assemble the C-shaped clip and the pin together, the pin having a tab or strip configured to extend through the slot and for attaching the pin to a second location on the garment, the slot being sufficiently small to prevent passage of the pin therethrough, the C-shaped clip and the pin having mating surfaces bounding the channel adjacent to at least one side of the slot, including a mating surface on the C-shaped clip adjacent to one side of the slot that faces away from the slot and toward the channel, and a mating surface on the pin that faces the slot when the pin is located in the channel, the mating surfaces being tapered at less than a 90 degree angle to the slot such that when the pin is located in the channel and a force is exerted against the tab or strip in a direction to pull the pin toward the slot, the mating surface of the clip adjacent to the one side of the slot will be drawn toward the slot to prevent passage of the pin therethrough; and at least one detent element comprising a tab extending sidewardly from the C-shaped clip centrally between the opposite ends thereof and bounding the slot, cooperatively receivable in a receptacle in the pin for retaining the pin in the channel, and releasable in a predetermined manner by moving the detent element away from the pin to allow slidably removing the pin from the channel through either of the open ends.

2. The apparatus of claim 1, wherein tab extends from the C-shaped clip in cantilever relation thereto between portions of the mating surface on the C-shaped clip adjacent to the one side of the slot.

3. The apparatus of claim 2, wherein the tab is separated from the portions of the mating surface on the C-shaped clip by gaps, respectively, to allow the tab to be moved relative thereto away from the C-shaped clip to remove the at least one detent from the receptacle.

4. The apparatus of claim 1, wherein the tab is flat and extends about parallel to the tab or strip of the pin.

5. The apparatus of claim 1, wherein the tab overlays the tab or strip of the pin when the pin is located in the channel.

6. The apparatus of claim 1, wherein the channel of the C-shaped clip and the pin have mating D-shapes when viewed from the end thereof.

7. The apparatus of claim 1, wherein the C-shaped clip and the pin have the mating surfaces bounding the channel adjacent to opposite sides of the slot.

8. The apparatus of claim 1, wherein the at least one detent element comprises a manually graspable feature connected to the tab and manually pullable away from the C-shaped clip to deform the tab to move the detent from an engaged state cooperatively received in the receptacle, to a release state removed from the receptacle to allow slidably removing the pin from the channel through the open end.

9. The apparatus of claim 1, comprising the garment, wherein the garment comprises a vest, the first location comprises a belt or cummerbund of the vest, and the second location comprises a front panel of the vest.

10. The apparatus of claim 1, comprising the garment, wherein the garment comprises a vest, the first location comprises a shoulder strap of the vest, and the second location comprises a front panel of the vest.

11. An assembly and release apparatus for a vest, comprising:

a C-shaped clip defining a channel open at opposite ends thereof, attached to one of a side element and a side edge of a front panel of the vest;

a pin attached to another of the side element and the front panel, slidably receivable in the channel of the C-shaped clip through either of the open opposite ends thereof to assemble the C-shaped clip and the pin together to connect the side element and the front panel with a tab or strip connected to the pin extending through a sidewardly facing slot bounded by spaced apart edges of the C-shape clip extending between the opposite ends of the C-shaped clip, respectively; and at least one detent element comprising a tab connected in cantilever relation to a portion of the C-shaped clip defining the channel between the opposite ends thereof, the detent element extending sidewardly between portions of one of the edges of the C-shaped clip beside the slot, and the detent element being cooperatively receivable in a receptacle in the pin when in the channel for retaining the pin in the channel, the detent element including a manually graspable feature and being deformable away from the pin by manually pulling the manually graspable feature to release from the receptacle to allow slidably removing the pin from the channel through either of the opposite ends of the C-shaped clip.

12. The apparatus of claim 11, further comprising a tab or strip attached along one side of the pin, the tab or strip being configured to extend through the slot when the pin is received in the channel, the tab or strip connecting the pin to said another of the side element and the front panel, and the slot being sufficiently small to prevent passage of the pin therethrough.

13. The apparatus of claim 11, further comprising a second C-shaped clip defining a channel open at least one end thereof, attached to one of an upper edge of the front panel of the vest and a shoulder strap;

a second pin attached to another of the upper edge of the front panel and the shoulder strap, slidably receivable in the channel of the second C-shaped clip through the open end thereof to assemble the second C-shaped clip and the second pin together to connect the front panel and the shoulder strap; and at least one detent element associated with one of the second C-shaped clip and the second pin, cooperatively engageable with the other of the second C-shaped clip and the second pin for retaining the second pin in the channel of the second C-shaped clip, and releasable in a predetermined manner to allow slidably removing the second pin from the channel of the second C-shaped clip through the open end thereof.

14. The apparatus of claim 13, wherein the vest can be donned by sliding the pins into the channels of the C-shaped clips and engaging the detent elements, respectively, and doffed by releasing the detent elements and sliding the pins from the clips.

15. The apparatus of claim 13, further comprising a second tab or strip attached along one side of the second pin, and a slot through the second C-shaped clip connecting with the channel thereof, the second tab or strip being configured to extend through the slot of the second C-shaped clip when the second pin is received in the channel thereof, the second tab or strip connecting the second pin to said another of the upper edge of the front panel and the shoulder strap, and the slot of the second C-shaped clip being sufficiently small to prevent passage of the second pin therethrough.

16. The apparatus of claim 11, wherein the at least one detent element is separated from the spaced apart edges of the C-shape clip by gaps, respectively, to allow deforming the at least one detent element to a release state removed from the receptacle.

17. The apparatus of claim 11, wherein the receptacle comprises a notch in the pin.

18. The apparatus of claim 17, wherein the C-shaped clip and the pin are elongate.

19. The apparatus of claim 11, wherein the channel of the C-shaped clip and the pin have mating D-shapes when viewed from the end thereof.

20. The apparatus of claim 11, wherein the C-shaped clip and the pin have mating surfaces bounding the channel adjacent to at least one side of the slot, including a surface on the C-shaped clip that faces the channel and a surface on the pin that faces the slot when the pin is located in the channel, which are tapered at less than a 90 degree angle to the slot such that when the pin is located in the channel and a force is exerted against the tab or strip in a direction to pull the pin toward the slot, the surface of the clip adjacent to the slot will be drawn toward the slot to prevent passage of the pin therethrough.

21. The apparatus of claim 20, comprising the mating surfaces on opposite sides of the channel, respectively.

22. A method of releasing a ballistic vest from a wearer's body, comprising steps of:

providing a first release assembly including a first C-shaped clip defining and bounding a channel open at opposite ends thereof, attached to a first element of the vest, a first pin attached to a second element of the vest and slidably received in the channel of the first C-shaped clip through the open end thereof connecting the first and second elements of the vest together with a tab or strip connected to the pin extending through a sidewardly facing slot bounded by spaced apart edges of the C-shape clip extending between the opposite ends of the C-shaped clip, respectively, and a detent element releasably retaining the first pin in the channel, the detent element comprising a tab connected in cantilever relation to a portion of the C-shaped clip defining the channel at a location about centrally between the opposite ends thereof, the detent element extending sidewardly between portions of one of the edges of the C-shaped clip beside the slot, and the detent element being cooperatively receivable in a receptacle in the pin when in the channel for retaining the pin in the channel, the detent element including a manually graspable feature and being deformable away from the pin by manually pulling the manually graspable feature to release from the receptacle to allow slidably removing the pin from the channel through either of the opposite ends of the C-shaped clip, the C-shaped clip and the pin having mating surfaces bounding the channel adjacent to at least one side of the slot including a mating surface on the C-shaped clip that faces the channel and a mating surface on the pin that faces the slot when the pin is located in the channel, the mating surfaces being tapered at less than a 90 degree angle to the slot such that when the pin is located in the channel and a force is exerted against the tab or strip in a direction to pull the pin toward the slot, the mating surface of the clip adjacent to the slot will be drawn toward the slot to prevent passage of the pin therethrough;

providing a second release assembly including a second C-shaped clip defining and bounding a second channel open at least one end, slidably receiving a second pin, connecting one of the elements of the vest to a third element, and a second detent element releasably retaining the second pin; and manually releasing the first and second detent elements and sliding the pins from the C-shaped clips, to disconnect the elements of the vest.

23. The method of claim 22, wherein the step of manually releasing the first detent element comprises pulling the detent element transversely relative to the first release assembly.

24. The method of claim 22, wherein the C-shaped clip and the pin of the first release assembly are elongate and the step of sliding the pin thereof from the C-shaped clip thereof comprises only longitudinal relative movement of the elements of the vest connected thereby.

* * * * *